US006183865B1

(12) United States Patent
Yabuki et al.

(10) Patent No.: US 6,183,865 B1
(45) Date of Patent: Feb. 6, 2001

(54) REGENERATED CELLULOSIC FIBERS AND PROCESS FOR PRODUCING THE SAME

(75) Inventors: Kazuyuki Yabuki; Yoshikazu Tanaka; Hisato Kobayashi, all of Ohtsu (JP)

(73) Assignee: Toyo Boseki Kabushiki Kaisha, Osaka-shi (JP)

( * ) Notice: Under 35 U.S.C. 154(b), the term of this patent shall be extended for 0 days.

(21) Appl. No.: 09/308,608

(22) Filed: Jul. 6, 1999

(30) Foreign Application Priority Data

| | | |
|---|---|---|
| Nov. 21, 1996 | (JP) | 8-311099 |
| Nov. 21, 1996 | (JP) | 8-311100 |
| Nov. 27, 1996 | (JP) | 8-316261 |
| Nov. 27, 1996 | (JP) | 8-316262 |
| May 29, 1997 | (JP) | 9-140173 |

(51) Int. Cl.[7] ..... D01F 2/00
(52) U.S. Cl. ..... 428/393; 428/364
(58) Field of Search ..... 428/364, 393

(56) References Cited

U.S. PATENT DOCUMENTS

| | | | | |
|---|---|---|---|---|
| 4,416,698 | * | 11/1983 | McCorsley | 106/163 R |
| 4,983,730 | * | 1/1991 | Domeshek et al. | 536/69 |
| 5,084,349 | * | 1/1992 | Sasaki et al. | 428/398 |
| 5,208,106 | * | 5/1993 | Tung | 428/397 |
| 5,540,874 | * | 7/1996 | Yamada et al. | 536/56 |
| 5,753,367 | * | 5/1998 | Takemura et al. | 428/372 |

FOREIGN PATENT DOCUMENTS

| | | |
|---|---|---|
| 0 648 808 | 4/1995 | (EP) . |
| 1-193338 | 8/1989 | (JP) . |
| 6-298999 | 10/1994 | (JP) . |
| 7-102079 | 4/1995 | (JP) . |

* cited by examiner

*Primary Examiner*—N Edwards
(74) *Attorney, Agent, or Firm*—Kenyon & Kenyon

(57) ABSTRACT

It is an object of the present invention to overcome the problem of fibrillation which is a drawback found in solvent-spun regenerated cellulosic fibers and to thereby provide high-quality regenerated cellulosic fibers. The regenerated cellulosic fibers are produced by the use of a spinning dope of cellulose dissolved in a solvent containing N-methylmorpholine N-oxide under the conditions that the average degree of polymerization of cellulose contained in the spinning dope is held to 400 or lower and 5% to 30% by weight of the cellulose is adjusted to a degree of polymerization of 500 or higher. Thus a pseudo-liquid-crystalline phenomenon can be allowed to occur in the stretched filaments during spinning, so that the resulting regenerated cellulosic fibers have improved resistance to fibrillation as well as improved dyeability and feeling.

5 Claims, 3 Drawing Sheets

REGENERATED CELLULOSIC FIBERS AND PROCESS FOR PRODUCING THE SAME

TECHNICAL FIELD

The present invention relates to regenerated cellulosic fibers which are produced by the use of a spinning dope of cellulose dissolved in a solvent containing N-methylmorpholine N-oxide (hereinafter abbreviated to NMMO) and to a process for producing the same. More particularly, it relates to a technique of manufacturing regenerated cellulosic fibers with a hollow or non-circular cross section, which have excellent dyeability, luster and feeling as well as improved resistance to fibrillation.

BACKGROUND ART

Methods for producing regenerated cellulosic fibers by the use of an NMMO-containing solvent have been known for a long time, as disclosed in JP-B 57-11566 and JP-B 60-28848, for example. The conventional methods of production utilizing the above solvent, however, have a serious drawback that the resulting regenerated cellulosic fibers are liable to cause fibrillation, which has become a hindrance to their general application. In spite of such a drawback, these methods have recently attracted attention again because they are environmentally friendly and are useful from an economical point of view and the resulting regenerated fibers have good physical properties to a certain extent as compared with the rayon process.

As for the above problem of fibrillation, many studies for solving the problem have been made, and some patent applications have been filed, as seen from JP-A 8-501356, JP-A 7-508320, and JP-A 8-49167, for example. In actual cases, however, these studies have not yet reached to the level that satisfactory effects can be obtained on a practical scale.

In the case where the regenerated cellulosic fibers produced by the use of the above solvent are applied to the filed of clothing or the like, it is believed that the formation of a hollow or non-circular cross section is useful for improving the luster or feeling of these fibers themselves or when they are made into woven or knitted fabrics. Notwithstanding, no studies have been made so far on the regenerated cellulosic fibers with a hollow or non-circular cross section produced by the use of an NMMO-containing solvent.

Furthermore, no one has considered using cellulose materials for the purpose of making a contribution to the preservation of global environment nor utilizing cellulose materials containing hemicellulose and lignin in large quantities.

The present invention has been made under the above circumstances with the objects of overcoming the problem of fibrillation which is found as a drawback of regenerated cellulosic fibers produced by the use of an NMMO-containing solvent as described above, as well as, in particular, of providing regenerated cellulosic fibers having excellent physical properties, feeling, dyeability and other properties for use in clothing, and of establishing a process of manufacture ensuring their stable production.

DISCLOSURE OF INVENTION

The regenerated cellulosic fiber of the present invention, which can overcome the above problem, is as follows:

(1) A regenerated cellulosic fiber which is produced by the use of a spinning dope of cellulose dissolved in a solvent containing N-methyl-morpholine N-oxide, the cellulose contained in the fiber having an average degree of polymerization of 400 or lower, and 5% to 30% by weight of the cellulose having a degree of polymerization of 500 or higher. The regenerated cellulosic fiber of the present invention exhibits excellent physical properties and appearance properties such as luster, and further have quite excellent resistance to fibrillation; it can therefore find wide applications for use in clothing.

The process for producing regenerated cellulosic fibers of the present invention is as follows:

(2) A process for producing regenerated cellulosic fibers by the use of a spinning dope of cellulose dissolved in an NMMO-containing solvent, characterized in that spinning is carried out by a dry spinneret wet spinning method under the conditions that the average degree of polymerization of cellulose contained in the spinning dope is held to 400 or lower and 5% to 30% by weight of the cellulose is adjusted to a degree of polymerization of 500 or higher. With the use of this process, the resulting fibers can have improved resistance to fibrillation.

The embodiments of the present invention may include the following examples.

A regenerated cellulosic fiber as described above in (1), wherein the regenerated cellulosic fiber contains lignin in an amount of 1% to 10% by weight based on the total weight of the cellulose.

A regenerated cellulosic fiber as described above in (1), wherein the regenerated cellulosic fiber has a hemicellulose content of 3% to 15% by weight based on the weight of the regenerated cellulosic fiber.

A regenerated cellulosic fiber as described above in (1), wherein the fiber has a hollow cross section.

A regenerated cellulosic fiber as described above in (1), wherein the fiber has a degree of non-circular cross section of 1.2 or higher.

A process for producing regenerated cellulosic fibers as described above in (2), wherein the spinning dope has a cellulose concentration of 10% to 25% by weight.

A process of production as described above in (2), wherein the spun filament extruded from a spinneret is cooled by a cooling gas before the spun filament is immersed in a coagulation bath.

A process of production as described in (2), wherein the spinneret has a non-circular or C-shaped cross section.

A process of production as described above in (2), wherein the spinneret has an approach portion with a taper angle of 10 to 45 degrees toward a nozzle tip.

The present invention will hereinafter be explained in detail.

The present inventors have gone on with their studies for solving the above problem from different points of view for the purpose of preventing fibrillation which is a drawback of the prior art as described above, particularly found in the regenerated cellulosic fibers produced by the use of an NMMO-containing solvent. As a result, they have found a new fact which has not been recognized so far by any person skilled in the art, i.e., when regenerated cellulosic fibers are produced by the use of the above solvent, the use of a special spinning dope which will cause a pseudo-liquid-crystalline phenomenon in the spinning step can give regenerated cellulosic fibers only causing quite low fibrillation.

They have further gone on with their studies and finally discovered that the degree of polymerization of cellulose dissolved in the spinning dope is very important to the occurrence of a pseudo-liquid-crystalline phenomenon as described above in the spinning step, which may be achieved by the use of a mixed cellulose solution having a specified average degree of polymerization of the cellulose and containing high molecular weight cellulose and low molecular weight cellulose at a specified ratio; when spinning is carried out by the use of such a mixed cellulose solution as a spinning dope, high-quality regenerated cellulosic fibers only causing quite low fibrillation and further having a hollow cross section can be obtained with reliability and ease. The term "pseudo-liquid-crystalline phenomenon" as used herein refers to a phenomenon that there occurs the transition of cellulose, similarly to the case of liquid crystal, in the fluidizing or stretching field during spinning.

Thus the present invention is characterized in that in the production of regenerated cellulosic fibers by a spinning method using a spinning dope of cellulose dissolved in an NMMO-containing solvent, both the average degree of polymerization of the cellulose dissolved in the spinning dope and the content of high molecular weight cellulose are specified so that a pseudo-liquid-crystalline phenomenon is allowed to occur in the spinning step.

More specifically, the average degree of polymerization of cellulose dissolved in the spinning dope should be held to 400 or lower, and the content of high molecular weight cellulose with a degree of polymerization of 500 or higher in the cellulose should be limited in the range of 5% to 30% by weight. It seems that the use of such a mixture of cellulose with different degrees of polymerization results in the formation of a structure composed mainly of maximally-stretched chains by phase separation of high molecular weight cellulose components, the space of which structure is filled with the low molecular weight cellulose components, and the resulting regenerated cellulose fibers have a structure just like a composite material, thereby preventing fibrillation.

In other words, the high molecular weight cellulose components become the main part in the pseudo-liquid-crystalline phenomenon so that they are oriented in the lengthwise direction of the fiber to the exhibit mechanical properties, whereas the low molecular weight cellulose components occupy the space between them to improve properties such as feeling, which are required for use in clothing. As a result of their additive or synergistic effects, excellent strength properties and feeling can be attained, and the composite fiber structure makes it possible to prevent fibrillation as low as possible.

To ensure the formation of such a composite structure and carry out the spinning operation smoothly, the average degree of polymerization of cellulose dissolved in the spinning dope may be held to 400 or lower. In addition, for ensuring the occurrence of a pseudo-liquid-crystalline phenomenon in the spinning step and attaining fiber mechanical properties in the lengthwise direction sufficient for the resulting regenerated cellulose fibers, the adjustment of the content of high molecular weight cellulose with a degree of polymerization of 500 or higher in the above cellulose to 5% by weight or higher is quite useful. That is, when the content of the high molecular weight cellulose is lower than 5% by weight, a pseudo-liquid-crystalline phenomenon as described above will be difficult to occur in the spinning step, so that the satisfactory prevention of fibrillation by phase separation cannot be attained and fiber mechanical properties in the lengthwise direction will be deteriorated. On the other hand, when the content of high molecular weight cellulose with a degree of polymerization of 500 or higher is higher than 30% by weight, phase separation will not occur, although there occurs a pseudo-liquid-crystalline phenomenon in the spinning step, and it will become difficult to attain the prevention of fibrillation. From the above viewpoint, the content of high molecular weight cellulose with a degree of polymerization of 500 or higher is preferably in the range of 5% to 25% by weight, more preferably 5% to 20% by weight.

The high molecular weight cellulose to be used in the present invention is not particularly limited to specific types, so long as it exhibits a degree of polymerization of 500 or higher when prepared in the spinning dope. Most generally used is a cellulose material with a degree of polymerization of 750 or higher, which is obtained from wood pulp as the raw material. However, if the above requirements on the degree of polymerization are met, linters, cotton fibers or the like may be, of course, used. The low molecular weight cellulose is not particularly limited, so long as it exhibits a degree of polymerization of 400 or lower when prepared in the spinning dope; and recycled products of rayon fibers are preferably used. In addition, cellulose materials obtained from recycled materials such as waste paper or recycled waste cotton can also be used. These raw materials of cellulose are usually used after they are wetted with industrial methanol or ethanol and then subjected to high-speed grinding or cutting, followed by drying.

Taking into consideration the acceptability to the global environment and the recent problem of reckless deforestation, non-woody cellulose is preferably used, and preferred examples from this point of view may include kenaf pulp; it is particularly preferred to use the whole stem of kenaf without separating the bast part and the core part thereof. In general, the bast part of kenaf is composed of high molecular weight cellulose with an average degree of polymerization of 700 or higher, and the cellulose contained in the core part is low molecular weight cellulose with a degree of polymerization of about 300, both of which are preferably used in the present invention.

Although the bast of kenaf contains lignin and hemicellulose, the present inventors have found that with the use of NMMO having very high dissolving power as a solvent, regenerated cellulosic fibers having excellent mechanical properties can be produced, even if lignin is contained in high concentration, and their dyeability and feeling can be improved.

The content of lignin preferred for improving dyeability and feeling is 1% by weight or higher based on the total weight of cellulose. Lignin can be contained to the upper limit at which it can be dissolved. If lignin remains undissolved, there is a tendency to inhibit the spinning properties; therefore, the content of lignin is preferably 1% to 10% by weight. When the lignin content is lower than 1% by weight, only a small effect can be obtained on the improvement of dyeability.

The content of hemicellulose preferred for improving dyeability and feeling is 3% to 15% by weight, preferably 3% to 12% by weight, and more preferably 4% to 10% by weight, based on the weight of the regenerated cellulosic fiber. When the hemicellulose content is lower than 3% by weight, no effect can be attained on the improvement of dyeability. When the hemicellulose content is higher than 15% by weight, spinning properties will be deteriorated and the physical properties of the resulting fibers will remarkably be lowered.

Preferred as the raw material of cellulose to produce regenerated cellulosic fibers with a composition as described above is kenaf pulp, which is particularly used without separating the bast part and the core part thereof. Any other ordinary cellulose materials may also be used. The lignin content and the hemicellulose content can be adjusted by mixing with a raw material such as kraft pulp, which contains relatively high amounts of hemicellulose components.

When a spinning dope is prepared, the mixing ratio of high molecular weight cellulose and low molecular weight cellulose may be adjusted so that the average degree of polymerization of cellulose dissolved in the spinning dope is 450 or lower and the content of high molecular weight cellulose with a degree of polymerization of 500 or higher is in the range of 5% to 30% by weight, preferably 5% to 25% by weight, and still more preferably 5% to 20% by weight.

In the preparation of a spinning dope, NMMO-containing solvents are used, preferably mixed solvents of NMMO and water, and particularly preferred are mixtures of NMMO and water at a mixing ratio by weight of 90:10 to 40:90.

To these solvents, cellulose materials as described above are added so that the concentration of the cellulose preferably becomes to 15% to 25% by weight, and then usually dissolved with a shear mixer or any other means at a temperature of about 80° C. to about 135° C. Thus the preparation of a spinning dope is achieved. Too low cellulose concentrations in the spinning dope will not involve a pseudo-liquid-crystalline phenomenon in the spinning. On the contrary, too high concentrations will make it difficult to carry out spinning because of a viscosity increase in excess. Therefore, the cellulose concentration of a spinning dope is preferably adjusted to the range of 15% to 25% by weight, more preferably 15% to 20% by weight, as described above.

The raw materials of cellulose may often cause a slight lowering of the degree of polymerization in the dissolution step. Therefore, the above degree of polymerization of cellulose specified in the present invention may be measured for the spinning dope after the dissolution step, and the mixing ratio of high molecular weight cellulose and low molecular weight cellulose to be dissolved as the raw material may be adjusted so that the average degree of polymerization and the content of high molecular weight cellulose meet the above requirements. In this case, the addition of a stabilizer such as hydrogen peroxide, oxalic acid or a salt thereof, gallic acid, methyldigallic acid, or glycoside for preventing the lowering of the degree of polymerization of cellulose and the degradation of NMMO during the dissolution is recommended as a preferred way.

The solution of a cellulose material dissolved in a mixed solvent of NMMO and water can easily become a high-concentration solution having relatively low viscosity, which is preferred for wet spinning, as described in "Sen'i-Gakkai-shi" 51, 423(1995), for example.

The solution of high viscosity (zero-shear viscosity at the dissolution temperature is about 5000 poise or higher) thus obtained is defoamed by a thin-film evaporator, then filtered, and fed to the spinning section. The spinning dope of high viscosity is introduced into the spinning head, metered by a gear pump, and fed into the spinning pack. The spinning temperature is preferably in the range of 90° C. to 135° C. When the temperature is lower than 90° C., the spinning dope will have too high viscosity, which makes it difficult to carry out spinning. When the temperature is much higher than 135° C., the degree of polymerization will be lowered by the degradation of cellulose, and the resulting regenerated cellulose fibers will have deteriorated physical properties, particularly tenacity.

The orifice of a spinneret may be useful when it has a larger value of L/D to improve the stability of a spinning dope, in which case, however, there arises a problem that the back pressure of spinning becomes large, which is not preferred. For the spinneret, a tapered orifice with a small approach angle is preferably used to prevent the occurrence of a turbulent flow inside of the orifice.

When a spinning dope contains foreign particles in quantity, it requires filtration. The spinning dope is preferably filtered through sand used in the spinning pack or through a filter made of thin metal fibers. In particular, filtration just before the spinneret is useful for this purpose.

To obtain regenerated cellulosic fibers with a hollow or non-circular cross section, a spinning nozzle with a C-shaped cross section is used in the case of a hollow cross section, such as shown in FIGS. 1A and 1B, and a spinning nozzle with a non-circular cross section is used in the case of a non-circular cross section, such as shown in FIGS. 2A–2D. The use of a spinning nozzle with such a cross section, however, deteriorates the drawability of a spinning dope. Therefore, if a spinning nozzle has an ordinary configuration, it becomes difficult to attain a sufficient spin stretch ratio in an air gap before the filament extruded from a spinneret is immersed in a coagulation solution. Even if a spinning dope of cellulose with an adjusted degree of polymerization as described above is used, a pseudo-liquid-crystalline phenomenon is difficult to occur, and the adjustment of a degree of non-circular cross section or the adjustment of a percentage of hollowness or the effect of an improvement of resistance to fibrillation becomes difficult to be effectively exhibited.

Then, the present inventors have continued to study the means of giving a sufficient spin stretch ratio even when a spinning nozzle with a particular cross section as described is used. As a result, they have found that the use of a spinneret having an approach portion with a sufficiently small taper angle $\alpha$ toward the nozzle tip makes it possible to prevent the occurrence of a turbulent flow in the orifice, and even if the nozzle tip has a particular configuration, to give a sufficient spin stretch ratio, whereby a pseudo-liquid-crystalline phenomenon can occur to attain the production of regenerated cellulosic fibers with a hollow or non-circular cross section and to effectively improve resistance to fibrillation. To obtain such effects, it is desirable that the taper angle $\alpha$ of the approach portion should preferably be adjusted to 45 degrees or smaller, more preferably 35 degrees or smaller. When the taper angle $\alpha$ is too small, there will arise a trouble in machining and there will occur a turbulent flow at the entrance to the approach portion, resulting in a tendency to inhibit the drawability of a spinning dope. The taper angle $\alpha$ is, therefore, preferably limited to about 10 degrees. Taking into consideration the drawability of a dope, machining for orifice manufacturing, and other properties together, the taper angle $\alpha$ is more preferably in the range of 15 to 30 degrees.

The spinning dope extruded from the spinneret is stretched in an area (air gap) before it is immersed in a coagulation solution. The use of a tapered orifice as described above makes it possible to give a sufficient spin stretch ratio, resulting in the certain occurrence of a pseudo-liquid-crystal-line phenomenon and attaining a prescribed degree of non-circular cross section and a prescribed percentage of hollowness as well as an improvement in the resistance to fibrillation.

In putting the present invention into practice, a spinning dope of high viscosity is spun at a higher temperature for the purpose of lowering its solution viscosity and then coagulated at a temperature lower than the spinning temperature, Therefore, a dry spinneret wet spinning method should be employed, in which a so-called air gap is provided between the extrusion of a dope filament from the spinning nozzle and the immersion of the dope filament in a coagulation bath, as described in JP-A 8-500863, for example. That is, if such a dry spinneret wet spinning method is employed when the present invention is put into practice, the high molecular weight cellulose in a high-concentration solution containing the high molecular weight cellulose and the low molecular weight cellulose as described above causes phase transition and phase separation in the flow or elongation field formed in the above air gap section, at which there occurs a pseudo-liquid-crystalline phenomenon, so that the high molecular weight cellulose forms a main chain structure of the fiber, making it easy to obtain regenerated cellulosic fibers with a non-circular or hollow cross section and giving a sufficient tenacity to the resulting regenerated cellulosic fibers even if they contain the low molecular weight cellulose in quantity. The spinning speed is not particularly limited; spinning is, however, usually carried out at a speed of 100 m/min. or higher, preferably 150 m/min. or higher.

In the above dry spinneret wet spinning, the occurrence of pseudo-liquid-crystalline transition requires a sufficient spin stretch ratio, and the spin stretch ratio is preferably 3.5 to 50.

For the length of an air gap, the distance between the spinneret and the liquid surface of a coagulation bath in usual cases is preferably adjusted to 20 to 500 mm so that a high rate of deformation can be attained while preventing molecular relaxation. When the distance is smaller than 20 mm, it will be difficult to obtain a sufficient spin stretch ratio. When the distance is greater than 500 mm, the occurrence of molecular relaxation will make it difficult to achieve pseudo-liquid-crystalline spinning. The cooling is preferably carried out with a quench chamber, and the conditions of a cooling air are preferably 10° C. to 30° C. for temperature and 0.2 to 1.0 m/sec. for air velocity.

For the coagulation bath, there may be used an aqueous solution of NMMO, preferably having an NMMO concentration of 10% to 50% by weight. When the NMMO concentration is lower than 10% by weight, the recovery rate of evaporated NMMO will become lower, which is uneconomical. On the contrary, when the NMMO concentration is much higher than 50% by weight, the coagulation of filaments will become insufficient. The NMMO concentration of a coagulation bath is more preferably in the range of 15% to 40% by weight. The temperature of a coagulation bath is preferably in the range of −20° C. to 20° C., more preferably −10° C. to 15° C. When the temperature is higher than 20° C., the coagulation will become insufficient, causing a deterioration of fiber performance. On the contrary, even if the coagulation bath is cooled in excess to a temperature lower than −20° C., the fiber performance cannot be further improved; cooling in excess is, therefore, not useful from an economical point of view. The filaments having passed through the coagulation bath is subsequently subjected to the water washing and drying steps, at which time the treatment after collecting filaments by a collecting apparatus such as a net conveyor is quite useful for making the equipment simpler. Furthermore, to make the collection by a net conveyor much easier, the use of a double kickback roll, an aspirator, or any other means as known in the art, for example, as disclosed in JP-B 47-29926, is recommended as a preferred method. In the case where the resulting regenerated cellulosic fibers are used as staple fibers, these fibers may be given crimps by a crimper provided in the process. The crimper is preferably of the what is called stuffing box type, although it may be, of course, a gear crimper. The crimper of the box type can also be used as a collecting apparatus with a net conveyor.

The bundle of filaments after washed with water and dried with a net conveyor is wound up as filament yarns with a prescribed linear density by a winder when to be obtained as filament fibers. Alternatively, the bundled filament fibers may be cut immediately or later when to be obtained as staple fibers. The cutter usually used may include rotary cutters and Guillotine cutters.

Figure 1:
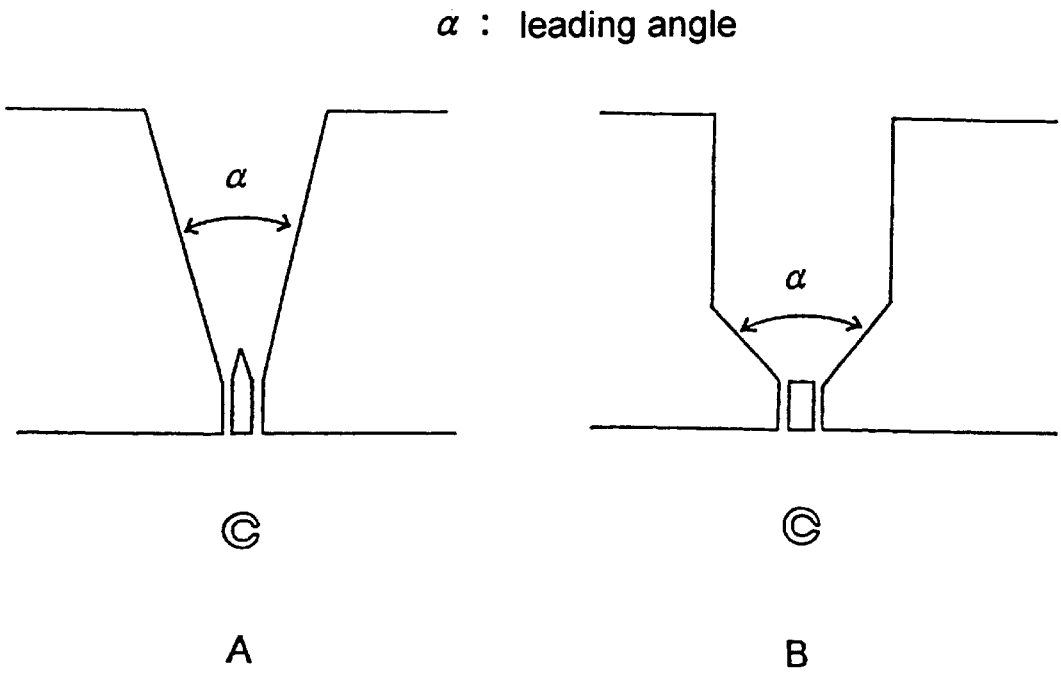
FIG. 1 is a view for explanation showing the internal structure of two different spinnerets and the configuration of extrusion openings of their spinning nozzles, which may be used for producing regenerated cellulosic fibers with a hollow cross section in the present invention.

The present invention is further illustrated by reference to working examples; however, as a matter of course, the present invention is not limited by the following working examples but can also be put into practice by the addition of any change or modification within the range conformable to the purport set forth hereinbefore and hereinafter, all of which are also included in the technical scope of the present invention. The methods of measurement for various kinds of performance used in the following working examples and comparative examples are as follows.

Measurement of Degree of Polymerization of Cellulose

The measurement was carried out by the copper ethylenediamine method as described in the reference "Koubunshi-Zairyo Shiken-hou Part 2", Koubunshi Gakkai ed., p. 267, Kyouritsu-shuppan (1965).

Evaluation of Fibrillation

In 300 ml of water is placed 5 g of regenerated cellulosic fibers cut in 5 mm, and the mixture is stirred with a commercially available mixer for 10 minutes. Twenty fibers after stirring are collected at random, observed through a microscope for the degree of fibrillation, and rated at five levels (◎, ○, Δ, X, and XX) by the standard sampling method.

Measurement of Dyeability

The test was carried out according to the procedure as defined in the section "7.30 Degree of Dye Exhaustion" of JIS-L-1015.

Determination of Lignin

A fiber sample was treated according to the procedure as defined in the section "Lignin" of JIS-P-8101-1994, and the measurement value was regarded as the lignin content.

Determination of Hemicellulose

A fiber sample was treated according to the procedure as defined in the section "5.6 β-Cellulose" of JIS-P-5101-1994, and the measurement value was used to obtain the hemicellulose content.

Measurement of Degree of Non-circular Cross Section

The cross section of a fiber was photographed through a microscope. The outer peripheral length (L) of the cross section and the circumferential length ($L_0$) of the circumscribed circle on the cross section were measured using tracing paper, and the degree of non-circular cross section was determined by the ratio $L/L_0$.

Measurement of Percentage of Hollowness

Short cut fibers of five filaments taken out from a fiber bundle at random were observed through an optical microscope and their cross sections were photographed. From the photograph, the area of a hollow portion in the cross section of each short cut fiber was determined. This area was divided by the whole area surrounded by the outer periphery of the cross section, and multiplied by 100. The values thus obtained for all the cross sections were averaged, and the average was regarded as a percentage of hollowness.

EXAMPLE 1

Using rayon pulp as the high molecular weight cellulose and rayon fibers as the low molecular weight cellulose, 15 parts by weight of each of their mixtures with varying their mixing ratio was dissolved in a mixture of 73 parts by weight of NMMO and 12 parts by weight of water at 110° C. under reduced pressure. The degree of polymerization of each component was determined by measuring the degree of polymerization of cellulose which had previously been obtained by precipitation and coagulation with water from each single dope of the high molecular weight cellulose or the low molecular weight cellulose. The degree of polymerization was 750 for the high molecular weight cellulose and 300 for the low molecular weight cellulose.

Each of the resulting solutions was used as a spinning dope, and the winding speed ($V_W$) was fixed at 50 m/min., under which the lowest through-put rate from a single hole making it possible to carry out stable spinning at each cellulose mixing ratio was determined. Under these and those conditions as shown in Table 1, spinning was carried out, in which a mixture of NMMO and water at a weight ratio of 20:80 was used as a coagulating solution.

The fiber properties and the degree of fibrillation of each of the resulting regenerated cellulosic fibers are shown in Table 1.

As can be seen from Table 1, the regenerated cellulosic fibers meeting the specified requirements of the present invention exhibited no fibrillation and had excellent fiber properties. If the cellulose in spinning dope has a higher content of the high molecular weight cellulose, the resulting regenerated cellulosic fibers may have an increased tenacity. However, higher contents of the high molecular weight cellulose over 30% by weight will give a tendency to cause fibrillation, whereas lower contents under 5% by weight will lead to a deterioration in tenacity. It is understood that both the cases are out of keeping with the objects of the present invention.

EXAMPLE 2

Using the same materials and the same composition ratio of solvents as described above in Example 1, spinning was carried out at a speed of 200 m/min., for two cases where the content of the high molecular weight cellulose was 15% by weight or 100% by weight. The spinneret used in the spinning had a tapered approach hole and a straight orifice with a diameter of 0.13 mm and a L/D value of 2.0, in which the approach hole had an opening angle of 20 degrees at the entrance side and 10 degrees in the middle portion. The dope was extruded from the spinneret, and the dope filaments were perpendicularly blown for cooling by a quench air at 20° C. with an air gap of 150 mm at a speed of 0.40 m/sec. The cooled filaments were introduced into a coagulation solution containing NMMO and water at a weight ratio of 20:80, and thereby coagulated before winding.

The resulting fibers were dried and then tested in the same manner as described in Example 1, and the results as shown in Table 2 were obtained. The regenerated cellulosic fibers obtained by combining the high molecular weight cellulose and the low molecular weight cellulose had excellent fiber properties and exhibited completely no fibrillation, whereas the regenerated cellulosic fibers obtained by using only the high molecular weight cellulose were very liable to cause fibrillation and cannot attain the objects of the present invention.

EXAMPLE 3

As the cellulose material, kraft pulp was used, which had previously been obtained from the whole stem of kenaf. The cellulose material was dissolved in a mixture of NMMO and water at 110° C. The composition ratio of the resulting dope was as follows: 18% by weight of cellulose, 73% by weight of NMMO, and 9% by weight of water. Using the dope, spinning was carried out in the same manner as described in Example 2. As the comparative example, lyocell fibers were used, which had been obtained in the same manner as above, except that wood pulp with a high α-cellulose content was used as the cellulose material. As shown in Table 3, high-quality fibers, although having a higher lignin content, were obtained in this working example and gave regenerated cellulosic fibers having just as satisfactory fiber properties as the lyocell fibers in the comparative example, and further having excellent dyeability as compared with the comparative example. Furthermore, these fibers had still more excellent feeling.

EXAMPLE 4

Using pulp obtained by kraft treatment from the bast of kenaf as the high molecular weight cellulose and pulp obtained by kraft treatment from the core of kenaf as the low molecular weight cellulose, these cellulose materials were mixed at a ratio of 20:80 and then dissolved in a mixture of NMMO and water at 110° C. under reduced pressure. The composition ratio of the resulting dope was as follows: 18% by weight of cellulose, 73% by weight of NMMO, and 9% by weight of water. The through-put rate and the spinning rate were set at 0.26 g/hole/min. and at 200 m/min., respectively The extruded filaments were introduced through an air gap into a coagulation bath. With the air gap, the dope filaments were perpendicularly blown for cooling by a quench air at 10° C. at a speed of 0.50 m/sec. The filaments after coagulated in the coagulation bath at 10° C. with a concentration of 20% by weight were washed with water and then wound up. The resulting fibers were dried and then measured. The results of measurement are as follows: linear density, 2.1 d; tenacity, 3.9 g/d; elongation, 7.6%; modulus, 180 g/d; degree of fiber polymerization, 380; lignin content, 2.1% by weight; and degree of dye exhaustion, 73%. Thus the fibers of the present invention exhibited a high degree of dye exhaustion and excellent fiber mechanical properties.

EXAMPLE 5

Using rayon pulp as the high molecular weight cellulose and rayon fibers as the low molecular weight cellulose, 15 parts by weight of their mixed cellulose at a former-to-latter weight ratio of 20:80 was dissolved in a mixture of 73 parts by weight of NMMO and 12 parts by weight of water at 110° C. under reduced pressure. The degree of polymerization for each cellulose material obtained by precipitation and coagulation with water from each single dope of the high molecular weight cellulose or the low molecular weight cellulose was 750 for the high molecular weight cellulose and 350 for the low molecular weight cellulose with the average degree of polymerization being 390.

Using the spinning dope, dry spinneret wet spinning was carried out at a spinning speed of 200 m/min., under the conditions as shown in Table 4, and the extruded filaments were introduced through an air gap of 300 mm in width into a coagulation bath. With the air gap, the dope filaments were perpendicularly blown for cooling by a quench air at 10° C. at a speed of 0.50 m/sec. The filaments after coagulated in the coagulation bath at 10° C. with a concentration of 20% by weight were washed with water, dried, and then wound up, followed by measurement of their physical properties and percentage of hollowness. The results are shown in Table 4, indicating that regenerated cellulosic fibers having excellent fiber properties and high dyeability were obtained.

EXAMPLE 6

Using rayon pulp as the high molecular weight cellulose and rayon fibers as the low molecular weight cellulose, 15 parts by weight of their mixed cellulose at a former-to-latter weight ratio of 20:80 was dissolved in a mixture of 73 parts by weight of NMMO and 12 parts by weight of water at 110° C. under reduced pressure. The degree of polymerization for each cellulose material obtained by precipitation and coagulation with water from each single dope of the high molecular weight cellulose or the low molecular weight cellulose was 750 for the high molecular weight cellulose and 300 for the low molecular weight cellulose with the average degree of polymerization being 368.

Using the spinning dope and a spinneret with a C-shaped configuration in the extrusion opening (the outer and inner diameters of the opening, 1500 $\mu$m and 1400 $\mu$m, respectively; the width of the closed portion, 500 $\mu$m), an approach angle of 30 degrees, and an inner structure as shown in FIG. 1A, spinning was carried out at a spinning speed of 50 m/min., and the extruded filaments were introduced through an air gap of 200 mm in width into a coagulation bath. With the air gap, the dope filaments were perpendicularly blown for cooling by a quench air at 10° C. at a speed of 0.50 m/sec. The filaments after coagulated in the coagulation bath at 10° C. with a concentration of 20% by weight were washed with water, dried, and then wound up, followed by measurement of their physical properties and percentage of hollowness. The results are shown in Table 5, indicating that regenerated cellulosic fibers with a hollow cross section, having excellent fiber properties were obtained.

EXAMPLE 7

Figure 3:
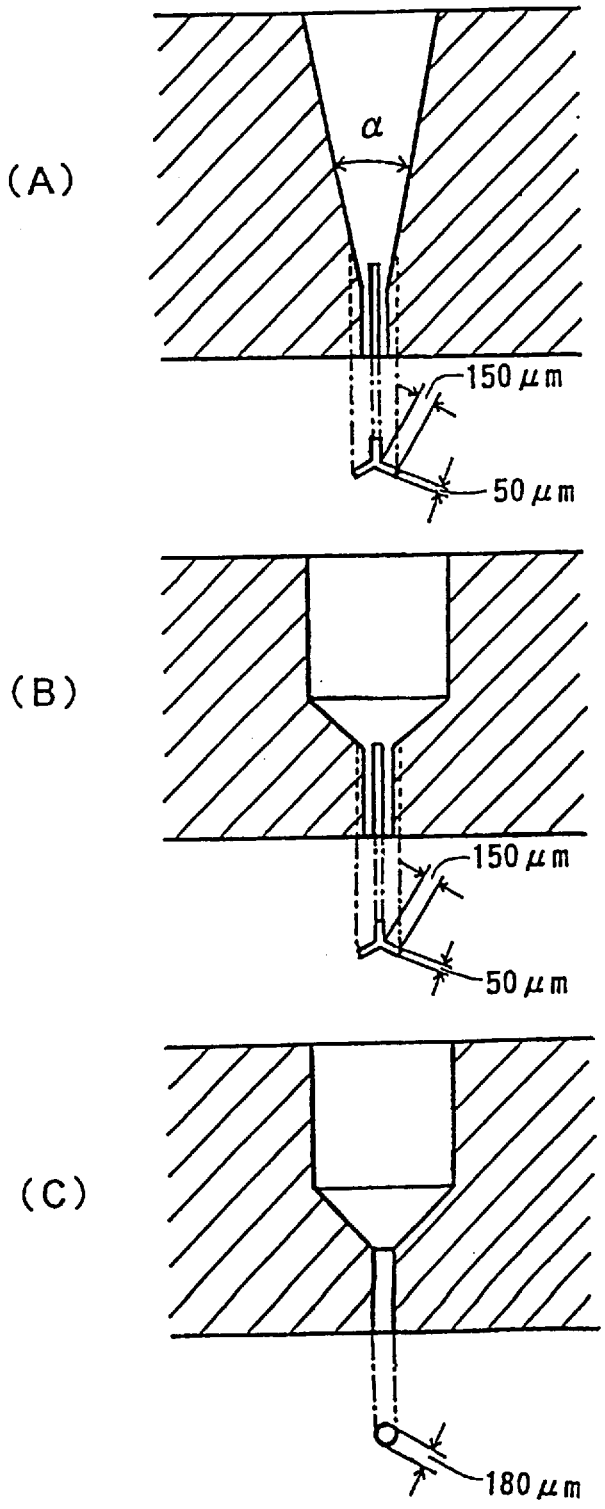
FIG. 3 is a view for explanation showing the internal structure of three different spinnerets and the configuration of extrusion openings of their spinning nozzles.

Using the same spinning dope as prepared in Example 6 and in the same manner as described in Example 6, except that a spinneret with an internal structure as shown in FIG. 3A was used and the spin stretch ratio was changed to 8.5 times, regenerated cellulosic fibers with a non-circular cross section were obtained.

The results are shown in Table 6. The regenerated cellulosic fibers had excellent fiber properties and a high degree of non-circular cross section.

TABLE 1

| Experiment No. | A | B | C | D | E | F | G | H | I |
|---|---|---|---|---|---|---|---|---|---|
| Cellulose H: degree of polymerization | 750 | 750 | 750 | 750 | 750 | 750 | 750 | 750 | 750 |
| Cellulose H: mixing ratio (wt %) | 0 | 0 | 10 | 15 | 20 | 50 | 75 | 100 | 100 |
| Cellulose L: degree of polymerization | 300 | 300 | 300 | 300 | 300 | 300 | 300 | 300 | — |
| Cellulose av. degree of polymerization | 300 | 323 | 345 | 368 | 390 | 525 | 638 | 750 | 750 |
| Cellulose concentration (wt %) | 15 | 15 | 15 | 15 | 15 | 15 | 15 | 15 | 15 |
| NMMO concentration (wt %) | 73 | 73 | 73 | 73 | 73 | 73 | 73 | 73 | 73 |
| Water concentration (wt %) | 12 | 12 | 12 | 12 | 12 | 12 | 12 | 12 | 12 |
| Spinning temperature (° C.) | 110 | 110 | 115 | 115 | 115 | 115 | 120 | 120 | 120 |
| Through-put rate (g/hole/min.) | 0.21 | 0.11 | 0.09 | 0.07 | 0.07 | 0.05 | 0.05 | 0.05 | 0.07 |
| Orifice diameter (mm) | 0.1 | 0.1 | 0.1 | 0.1 | 0.1 | 0.1 | 0.1 | 0.1 | 0.1 |
| Spinning speed (m/min.) | 0.44 | 0.23 | 0.19 | 0.15 | 0.15 | 0.1 | 0.11 | 0.11 | 0.15 |
| Air gap (mm) | 20 | 20 | 20 | 20 | 20 | 20 | 20 | 20 | 20 |
| Winding speed (m/min.) | 50 | 50 | 50 | 50 | 50 | 50 | 50 | 50 | 50 |
| Spin stretch ratio (times) | 1.9 | 3.6 | 4.5 | 5.6 | 5.6 | 7.3 | 7.3 | 7.3 | 5.6 |
| Coagulation bath concentration (wt %) | 20 | 20 | 20 | 20 | 20 | 20 | 20 | 20 | 20 |
| Coagulation bath temperature (° C.) | 10 | 10 | 10 | 10 | 10 | 10 | 10 | 10 | 10 |
| Regenerated cellulose | | | | | | | | | |
| liner density (d) | 5.6 | 2.9 | 2.4 | 1.9 | 1.9 | 1.5 | 1.5 | 1.5 | 1.9 |
| tenacity (g/d) | 2.1 | 3.8 | 4.1 | 4.4 | 4.7 | 5.3 | 5.8 | 6.0 | 5.7 |
| elongation (%) | 20.5 | 15.3 | 13.7 | 11.5 | 10.2 | 9.8 | 8.3 | 7.6 | 8.3 |
| modulus (g/d) | 95 | 120 | 128 | 143 | 161 | 184 | 192 | 206 | 188 |
| Fibrillation | ◎ | ◎ | ◎ | ◎ | ○ | Δ | X | XX | XX |

Cellulose H: high molecular weight cellulose; Cellulose L: low molecular weight cellulose

TABLE 2

| Experiment No. | J | K |
|---|---|---|
| Cellulose H: degree of polymerization | 750 | 750 |
| Cellulose H: mixing ratio (wt %) | 15 | 100 |
| Cellulose L: degree of polymerization | 300 | — |
| Cellulose av. degree of polymerization | 368 | 750 |
| Cellulose concentration (wt %) | 15 | 15 |
| NMMO concentration (wt %) | 73 | 73 |
| Water concentration (wt %) | 12 | 12 |
| Spinning temperature (° C.) | 115 | 120 |
| Through-put rate (g/hole/min.) | 0.32 | 0.32 |
| Orifice diameter (mm) | 0.13 | 0.1 |
| Extrusion speed (m/min.) | 0.40 | 0.40 |

TABLE 2-continued

| Experiment No. | J | K |
|---|---|---|
| Air gap (mm) | 150 | 150 |
| Quench air temperature (° C.) | 20 | 20 |
| Quench air velocity (m/min.) | 0.4 | 0.4 |
| Winding speed (m/min.) | 200 | 200 |
| Spin stretch ratio (times) | 8.3 | 8.3 |
| Coagulation bath concentration (wt %) | 20 | 20 |
| Coagulation bath temperature (° C.) | 10 | 10 |
| Regenerated cellulose | | |
| liner density (d) | 2.2 | 2.2 |
| tenacity (g/d) | 5.1 | 7.5 |
| elongation (%) | 10.7 | 7.2 |
| modulus (g/d) | 163 | 226 |
| Fibrillation | ◎ | XX |

Cellulose H: high molecular weight cellulose
Cellulose L: low molecular weight cellulose

TABLE 3

| Cellulose material | Example 3 kenaf whole stem | Comp. Example soft wood pulp |
|---|---|---|
| Cellulose concentration (wt %) | 18 | 18 |
| NMMO concentration (wt %) | 70 | 70 |
| Water concentration (wt %) | 12 | 12 |
| Spinning temperature (° C.) | 110 | 110 |
| Through-put rate (g/hole/min.) | 0.14 | 0.14 |
| Air gap (mm) | 250 | 250 |
| Quench air temperature (° C.) | 10 | 10 |
| Quench air velocity (m/sec.) | 0.5 | 0.5 |
| Winding speed (m/min.) | 150 | 150 |
| Spin stretch ratio (times) | 5.6 | 5.6 |
| Coagulation bath concentration (wt %) | 20 | 20 |
| Coagulation bath temperature (° C.) | 10 | 10 |
| Fiber properties | | |
| Linear density (d) | 1.5 | 1.5 |
| Tenacity (g/d) | 3.9 | 5.5 |
| Elongation (%) | 7.6 | 8.9 |
| Modulus (g/d) | 183 | 180 |
| Degree of polymerization | 385 | 470 |
| Lignin content (wt %) | 1.8 | 0.4 |
| Degree of dye exhaustion (%) | 79 | 51 |

TABLE 4

| | Example |
|---|---|
| Cellulose H: degree of polymerization | 550 |
| Cellulose H: mixing ratio (wt %) | 20 |
| Cellulose L: degree of polymerization | 350 |
| Cellulose av. degree of polymerization | 390 |
| Cellulose concentration (wt %) | 15 |
| NMMO concentration (wt %) | 73 |
| Water concentration (wt %) | 12 |
| Spinning temperature (° C.) | 110 |
| Through-put rate (g/hole/min.) | 0.31 |
| Air gap (mm) | 300 |
| Quench air temperature (° C.) | 10 |
| Quench air velocity (m/sec.) | 0.5 |
| Winding speed (m/min.) | 200 |
| Spin stretch ratio (times) | 8.5 |
| Coagulation bath concentration (wt %) | 20 |
| Coagulation bath temperature (° C.) | 10 |
| Fiber properties | |
| Linear density (d) | 2.1 |
| Tenacity (g/d) | 4.3 |
| Elongation (%) | 9.1 |
| Modulus (g/d) | 184 |

TABLE 4-continued

| | Example |
|---|---|
| Hemicellulose content (wt %) | 3.4 |
| Degree of dye exhaustion (%) | 72 |

TABLE 5

| | Example |
|---|---|
| Cellulose H: degree of polymerization | 750 |
| Cellulose H: mixing ratio (wt %) | 15 |
| Cellulose L: degree of polymerization | 300 |
| Cellulose av. degree of polymerization | 368 |
| Cellulose concentration (wt %) | 15 |
| NMMO concentration (wt %) | 73 |
| Water concentration (wt %) | 12 |
| Spinning temperature (° C.) | 115 |
| Through-put rate (g/hole/min.) | 0.41 |
| Air gap (mm) | 50 |
| Quench air temperature (° C.) | 10 |
| Quench air velocity (m/sec.) | 0.5 |
| Winding speed (m/min.) | 50 |
| Spin stretch ratio (times) | 26 |
| Coagulation bath concentration (wt %) | 20 |
| Coagulation bath temperature (° C.) | 10 |
| Fiber properties | |
| Linear density (d) | 11 |
| Tenacity (g/d) | 4.9 |
| Elongation (%) | 9.5 |
| Modulus (g/d) | 171 |
| Hollowness (%) | 15 |

TABLE 6

Figure 2:
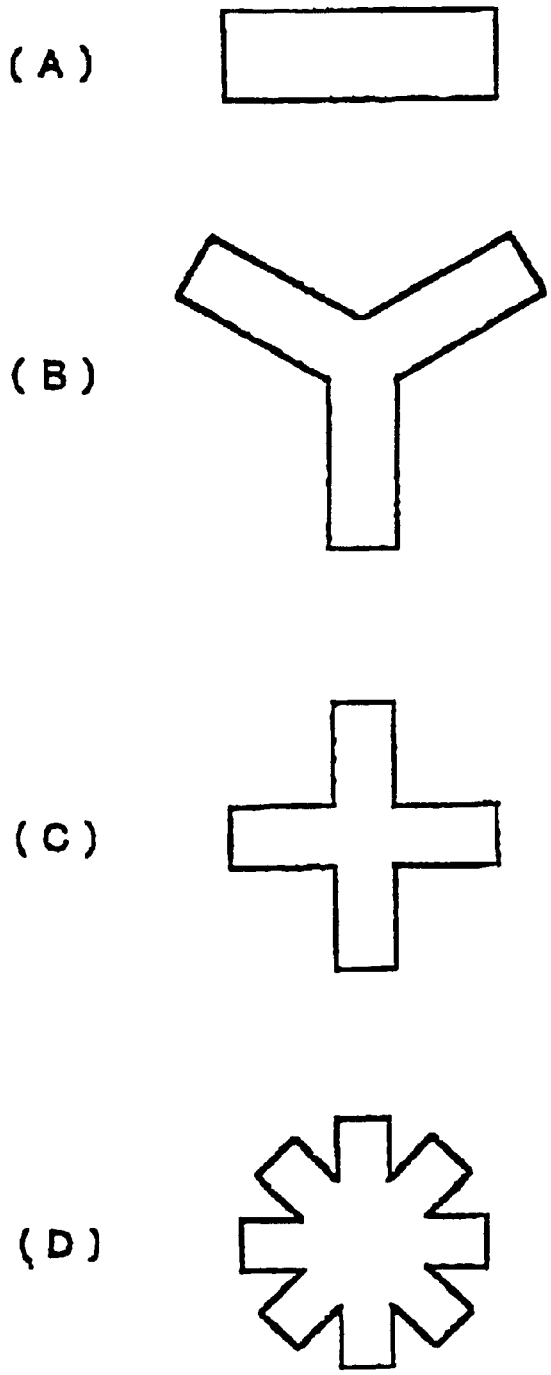
FIG. 2 is a view for explanation showing the configuration of four different spinning nozzle tips, which may be used for producing regenerated cellulosic fibers with a non-circular cross section in the present invention.

| Experiment No. | J |
|---|---|
| Cellulose H: degree of polymerization | 750 |
| Cellulose H: mixing ratio (wt %) | 15 |
| Cellulose L: degree of polymerization | 300 |
| Cellulose av. degree of polymerization | 368 |
| Cellulose concentration (wt %) | 15 |
| NMMO concentration (wt %) | 73 |
| Water concentration (wt %) | 12 |
| Spinning temperature (° C.) | 115 |
| Through-put rate (g/hole/min.) | 0.4 |
| Configuration of spinneret (FIG. 2) | A |
| taper angle α | 30 |
| Air gap: mm | 200 |
| Cooling air temperature: ° C. | 10 |
| Cooling air speed: m/sec. | 0.5 |
| Winding speed: m/min. | 200 |
| Spin stretch ratio: times | 12.3 |
| Coagulation bath concentration (NMMO wt %) | 20 |
| Coagulation bath temperature (° C.) | 10 |
| Regenerated cellulose | |
| linear density (d) | 2.7 |
| tenacity (g/d) | 4.9 |
| elongation (%) | 9.5 |
| modulus (g/d) | 171 |
| degree of non-circular cross section | 1.42 |

Cellulose H: high molecular weight cellulose
Cellulose L: low molecular weight cellulose

Industrial Applicability

The regenerated cellulosic fibers of the present invention have excellent resistance to fibrillation as well as excellent dyeability and feeling, and are, therefore, suitable for use in clothing.

What is claimed is:

1. A regenerated cellulosic fiber comprising, a cellulose composition having an average degree of polymerization of 400 or lower and 5% to 30% by weight of said cellulose composition having a degree of polymerization of 500 or more, wherein said cellulosic fiber is produced by spinning a dope of cellulose dissolved in a solvent containing N-methylmorpholine-oxide.

2. A regenerated cellulosic fiber according to claim 1, wherein the regenerated cellulosic fiber contains lignin in an amount of 1% to 10% by weight based on the total weight of the cellulose.

3. A regenerated cellulosic fiber according to claim 1, wherein the regenerated cellulosic fiber has a hemicellulose content of 3% to 15% by weight based on the weight of the regenerated cellulosic fiber.

4. A regenerated cellulosic fiber according to claim 1, wherein the fiber has a hollow cross section.

5. A regenerated cellulosic fiber according to claim 1, wherein the fiber has a degree of non-circular cross section of 1.2 or higher.

* * * * *